US009044109B2

(12) United States Patent
De Pagter et al.

(10) Patent No.: US 9,044,109 B2
(45) Date of Patent: Jun. 2, 2015

(54) CONTAINER FOR PLANTS THAT CAN BE FILLED WITH WATER

(75) Inventors: Janus Adriaan Willem De Pagter, Dinteloord (NL); Simon Eduard Niekolaas, Schipluiden (NL); Jeroen Johan Bruijns, Zevenbergen (NL)

(73) Assignee: Pagter & Partners International B.V., Roosendaal (NL)

( * ) Notice: Subject to any disclaimer, the term of this patent is extended or adjusted under 35 U.S.C. 154(b) by 1863 days.

(21) Appl. No.: 11/887,772

(22) PCT Filed: Apr. 4, 2006

(86) PCT No.: PCT/NL2006/050072

§ 371 (c)(1),
(2), (4) Date: Aug. 5, 2009

(87) PCT Pub. No.: WO2006/107204

PCT Pub. Date: Oct. 12, 2006

(65) Prior Publication Data

US 2009/0293351 A1 Dec. 3, 2009

(30) Foreign Application Priority Data

Apr. 4, 2005 (NL) ..... 1028692

(51) Int. Cl.

| | |
|---|---|
| ***A47G 7/00*** | (2006.01) |
| ***A47G 7/07*** | (2006.01) |
| ***A47G 7/06*** | (2006.01) |

(52) U.S. Cl.
CPC ... *A47G 7/07* (2013.01); *A47G 7/06* (2013.01)

(58) Field of Classification Search
USPC ..... 47/41.12, 41.01, 41.1, 65.5, 66.1, 66.6, 47/79, 81; 442/119; 206/423
See application file for complete search history.

(56) References Cited

U.S. PATENT DOCUMENTS

| | | | | | |
|---|---|---|---|---|---|
| 2,900,760 | A | * | 8/1959 | Tupper | 47/41.11 |
| 3,000,722 | A | * | 9/1961 | Linnolt | 71/11 |
| 3,481,075 | A | | 12/1969 | Dastoli et al. | |
| 3,552,059 | A | | 1/1971 | Moore | |
| 3,733,746 | A | * | 5/1973 | Allen, Jr. | 47/79 |
| 3,928,936 | A | * | 12/1975 | Wollen | 47/41.15 |
| 4,413,032 | A | * | 11/1983 | Hartmann et al. | 442/118 |
| 4,621,733 | A | * | 11/1986 | Harris | 206/423 |
| 4,789,584 | A | * | 12/1988 | Perrin | 428/159 |
| 4,858,381 | A | * | 8/1989 | Walton et al. | 47/79 |
| 4,936,046 | A | * | 6/1990 | Miller | 47/41.01 |
| 4,948,009 | A | * | 8/1990 | Sawatani | 220/229 |

(Continued)

FOREIGN PATENT DOCUMENTS

| | | | |
|---|---|---|---|
| BE | 1009645 | A6 | 6/1997 |
| CA | 2 207 510 | A1 | 12/1998 |

(Continued)

*Primary Examiner* — Rob Swiatek
*Assistant Examiner* — Michael Kreiner
(74) *Attorney, Agent, or Firm* — The Webb Law Firm

(57) ABSTRACT

A container, in which a quantity of water can be accommodated, includes a base, a peripheral wall that is upright with respect to the base, a water barrier provided within the peripheral wall and extending towards the base, an insertion opening in which the stem or stems of plant products, such as flowers, can be accommodated in such a way that these have access to the quantity of water, as well as retaining member for retaining the stems. The retaining member is designed for holding the stems pressed down in the direction of the base under preloading.

21 Claims, 2 Drawing Sheets

(56) References Cited

U.S. PATENT DOCUMENTS

| | | | | | |
|---|---|---|---|---|---|
| 5,057,361 | A * | 10/1991 | Sayovitz et al. | 442/118 |
| 5,469,654 | A * | 11/1995 | Thompson | 47/41.12 |
| 5,491,929 | A * | 2/1996 | Peacock et al. | 47/84 |
| 5,526,942 | A * | 6/1996 | Domurat | 211/60.1 |
| 6,178,688 | B1 * | 1/2001 | Keating | 47/41.12 |
| 6,239,047 | B1 * | 5/2001 | Erdos et al. | 442/119 |
| 6,630,415 | B2 * | 10/2003 | Phillips et al. | 442/119 |
| 2004/0043688 | A1 * | 3/2004 | Soerens et al. | 442/149 |
| 2005/0102900 | A1 * | 5/2005 | Valiquette et al. | 47/79 |
| 2005/0138862 | A1 * | 6/2005 | O'Connor | 47/41.12 |
| 2006/0096170 | A1 * | 5/2006 | Wright | 47/41.01 |
| 2006/0112624 | A1 * | 6/2006 | Bortman | 47/41.12 |
| 2006/0223397 | A1 * | 10/2006 | Wu | 442/118 |

FOREIGN PATENT DOCUMENTS

| | | | |
|---|---|---|---|
| CN | 2452390 | Y | 10/2001 |
| DE | 30 14 032 | A1 | 11/1981 |
| EP | 0381803 | A1 | 8/1990 |
| EP | 0 440 033 | A1 | 8/1991 |
| FR | 2 599 934 | A1 | 12/1987 |
| FR | 2 626 158 | A1 | 7/1989 |
| FR | 2823489 | A1 | 10/2002 |
| GB | 15872 | | 0/1911 |
| JP | 61-97125 | | 6/1986 |
| JP | 62-193472 | | 12/1987 |
| JP | 01-159760 | | 11/1989 |
| JP | 04-074934 | | 6/1992 |
| JP | 07-232782 | | 9/1995 |
| JP | 09-047154 | | 2/1997 |
| JP | 2002-209446 | | 7/2002 |
| NL | 9400634 | A | 12/1995 |
| NL | 1015844 | C2 | 2/2002 |
| NL | 1023426 | | 11/2004 |
| UA | 28101 | U | 11/2007 |
| WO | 2004/034784 | A2 | 4/2004 |

* cited by examiner

CONTAINER FOR PLANTS THAT CAN BE FILLED WITH WATER

The invention relates to a container in which a quantity of water can be accommodated, comprising a base, a peripheral wall that is upright with respect to the base, a lid comprising an insertion opening and provided on the peripheral wall, a water barrier provided within the peripheral wall and extending towards the base, in which insertion opening the stem or stems of plant products, such as flowers, can be accommodated in such a way that these have access to the quantity of water, as well as retaining means for retaining the stems.

A container of this type is disclosed in NL-C-9400634. The water barrier of this known container ensures that no water can escape when it is in a sloping or even horizontal position. As a result it should be ensured that the stems always have sufficient access to the water to keep the flowers fresh. The advantage is that water spillage during transport and the like is also minimised.

With the known container, the insertion opening has been provided under the water barrier and has been provided with a number of radial spokes or strips. It is the intention that the stems are retained in the insertion opening. The retention effect should arise once the stems are pushed into these passages. As a result, although the stems should remain more or less in place, even in a sloping or horizontal position, it is not always properly ensured that they remain in contact with the water. The vascular bundles take up water at the cut surface (the bottom of the stem), so the bottom is pushed into the water and thus remains in contact with water. In fact, pressing the stems into the passages does not always mean that the desired retention effect is continually obtained.

The aim of the invention is therefore to provide a container of the abovementioned type that does afford a proper retention effect. This is achieved in that the retaining means are designed for holding the stems pressed down in the direction of the base under preloading and are located in the insertion opening of the lid.

Because the stems are held pressed down in the direction of the base, it is continually ensured that that these are retained properly in the desired position, that is to say in such a way that continuous supply though the bottom of the stems to the vascular bundles in the stems is ensured. Even negative influences, such as inclination or a horizontal position, can be compensated as a result. The retaining means exert, as it were, a pretension on the stems, which pretension ensures that the contact with the base or a water-containing medium at that location is maintained. Furthermore, the container according to the invention has the advantage that there can be a relatively large distance between the retaining means and the base of the water-containing medium. As a result the stems can be pressed down better.

The retaining means are preferably situated in the insertion opening and can, for example, comprise lips that are oriented towards the middle of the opening. In particular, the insertion opening can have a round shape, such that the retaining means comprise lips oriented radially with respect to the insertion opening.

In order to obtain the desired pretensioning effect, the lips can be made in different ways; in particular the lips can be mounted so that they can turn or pivot. When a bunch of stems that has a somewhat larger diameter than the diameter of the opening enclosed by the lips is inserted, a penetration effect is obtained that produces the desired pretensioned pressing down of the stems in the direction of the base.

The water barrier can comprise a ring adjoining the edge of the peripheral wall facing away from the base and oriented towards the interior and a sleeve that adjoins the inside edge of the ring, is oriented towards the base, partially overlaps the peripheral wall and is situated at some distance from the base. In this case the lips are preferably made as an integral part of the ring.

The material which is located in the container can consist of several known substances, such as rockwool, oasis and several foam types. A substrate like rockwool is applied to a large extent in greenhouses. The weight thereof is limited, whereas the water retaining capacity is large. This is of importance in the case of transport packagings. Such transport packagings should have sufficient amount of water so as to keep the transported flowers fresh during a certain amount of time, that is to say to provide them during such time with water.

Despite these advantages a serial like rockwool however also has an important disadvantage. This disadvantage becomes clear when processing the used containers as waste. As already mentioned, the container of fun consists of a cardboard or plastic, that can be processed to waste in a specific way. Rockwool however should be processed to waste in a completely different way. This means that the container and the material should be separated from each other, before a responsible waste processing can be obtained. Such separation is cumbersome, and also costly having regard to the effect that it is labour-intensive.

According to the invention, a further improvement can be obtained in case the container and the material are manufactured from a substance which is equal with respect to waste processing, such that the container and the material can be treated in a similar way in waste processing. The advantage thereof is that also the later waste processing brings no or less problems and costs. This is based on the inside that the container and the material can essentially be manufactured from the same material, that is to say types of material which can be subjected to the same waste processing. In the prior art container the first aim is watertightness, it is to say counteracting meeting of water.

In contrast, the object of the known material is to absorb as much water as possible. It is to say, the material must indeed be very accessible to water. By obtaining these properties of the container, it is to say it is watertightness, and of the material, that is to say its water absorbing capacity, by means of the same substance, at a later stage also a common waste processing can be obtained. Thereby also environmental problems, which would occur when processing to waste different types of materials, can be prevented.

According to a preferred embodiment, the container may comprise an injection moulded plastic substance and material make comprise fibres of the same plastic substance. The fibres can be carried out in many different ways, but preferably they are spun. Preferably they are carried out as a non-woven assembly. Preferably the fibres can be intermingled.

The substance of the container and of the material can be biologically degradable. As examples of such material types for the container and the material, polyester and polypropylene are mentioned.

The invention is also related to a method for processing as waste of a container as described before, comprising the steps of:

removing together the container and the material, subjecting the container and the material together to waste processing, such as by means of heating, burning, grinding, and the like thereof.

The invention will be explained in more detail below with reference to an illustrative embodiment shown in the figures.

Figure 1:
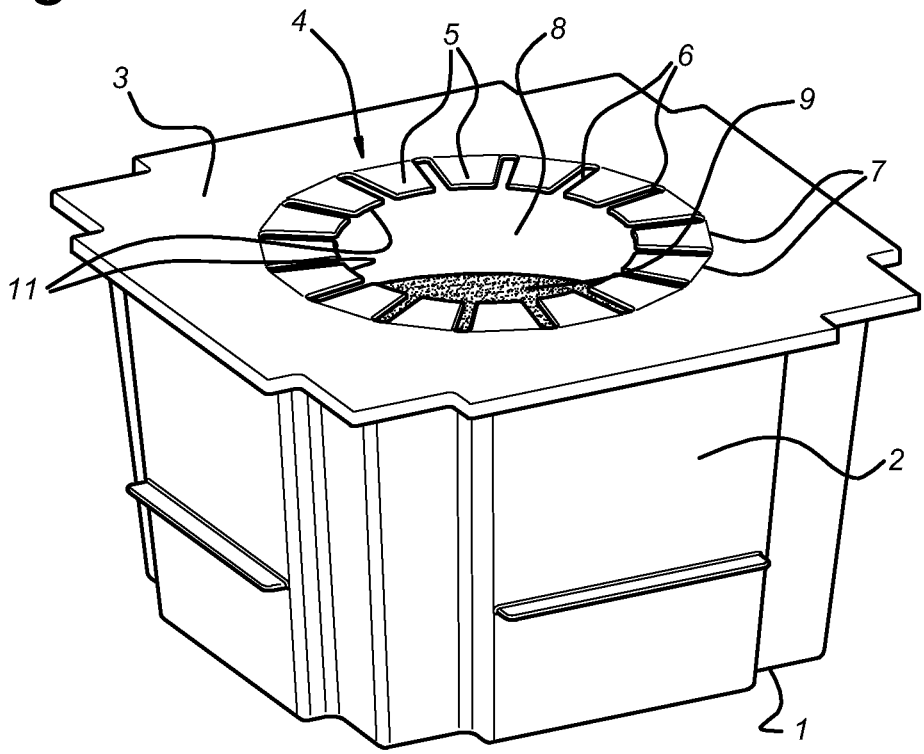
FIG. 1 shows a perspective view of a container according to the invention.
Figure 2:
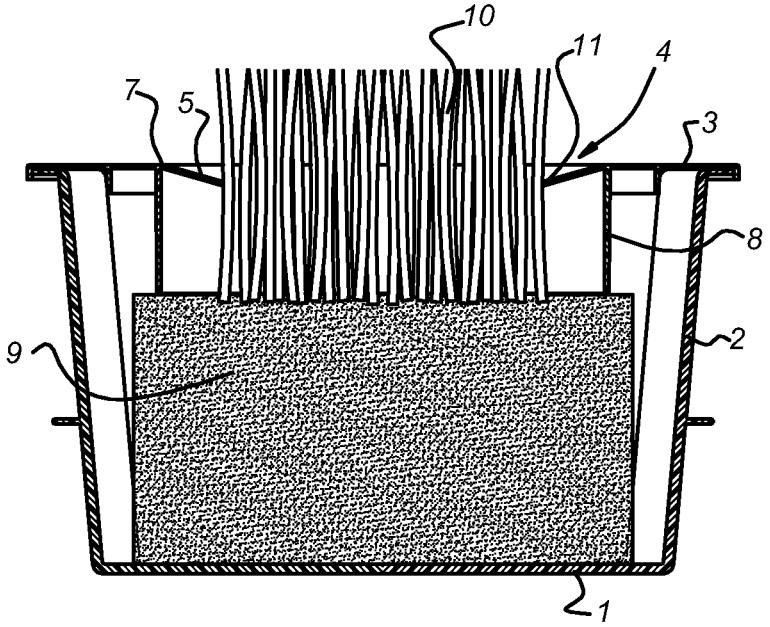
FIG. 2 shows a vertical cross-section though the container with a number of stems accommodated therein.

The container shown in FIGS. 1 and 2 comprises a base 1 and a peripheral wall 2. A lid 3, in which there is an insertion opening 4, is fitted on the top edge of the peripheral wall 2. This insertion opening 4 is made up of a series of lips 5 that are separated by slots 6. These lips 5 are flexible and can turn to some extent about a base 7.

Underneath the lid 3, near the base 7 of the lips 5, a sleeve 8 is provided that extends in the direction of the base 1. An amount of water-absorbent material, such as mineral wool 9, is accommodated on the base 1. The sleeve extends down to the top of this layer of mineral wool 9.

The container according to the invention is partially filled with water, which is principally located in the layer of mineral wool 9. Because of the water barrier that is formed by the sleeve 8, it is ensured that no water will escape from the container when this is tipped or even held upside-down.

The container according to the invention is used to provide the stems of flowers with water for a certain amount of time. For this purpose, the stems 10 are inserted in the insertion opening 4. The entire diameter of the bundle of stems 10 is preferably greater than diameter determined by the ends 11 of the lips. The lips 5 are pushed downwards to a certain extent as a result of the insertion operation, such that they tip about their base 7 as indicated in FIG. 2. The ends of the stems 10 eventually come into contact with the somewhat flexible surface of the layer of mineral wool 9. As soon as the stems come into contact with the layer of mineral wool 9, they push this layer in somewhat resiliently.

This layer is prevented from springing back because the lips 5 counteract this. These lips 5 cannot move upwards resiliently any longer, since they are forcibly held in the inclined position by the excess size of the bunch of stems 10. In this way it is ensured that the ends of the stems 10 are continually pressed down against the layer of mineral wool 9 in a reliable manner, even should the container with the stems tip or be held upside-down.

The container according to the invention can be made in many different ways. As an example, completion of the container with a tube (not shown) that protects the stems and the flower heads can be mentioned.

Figure 3:
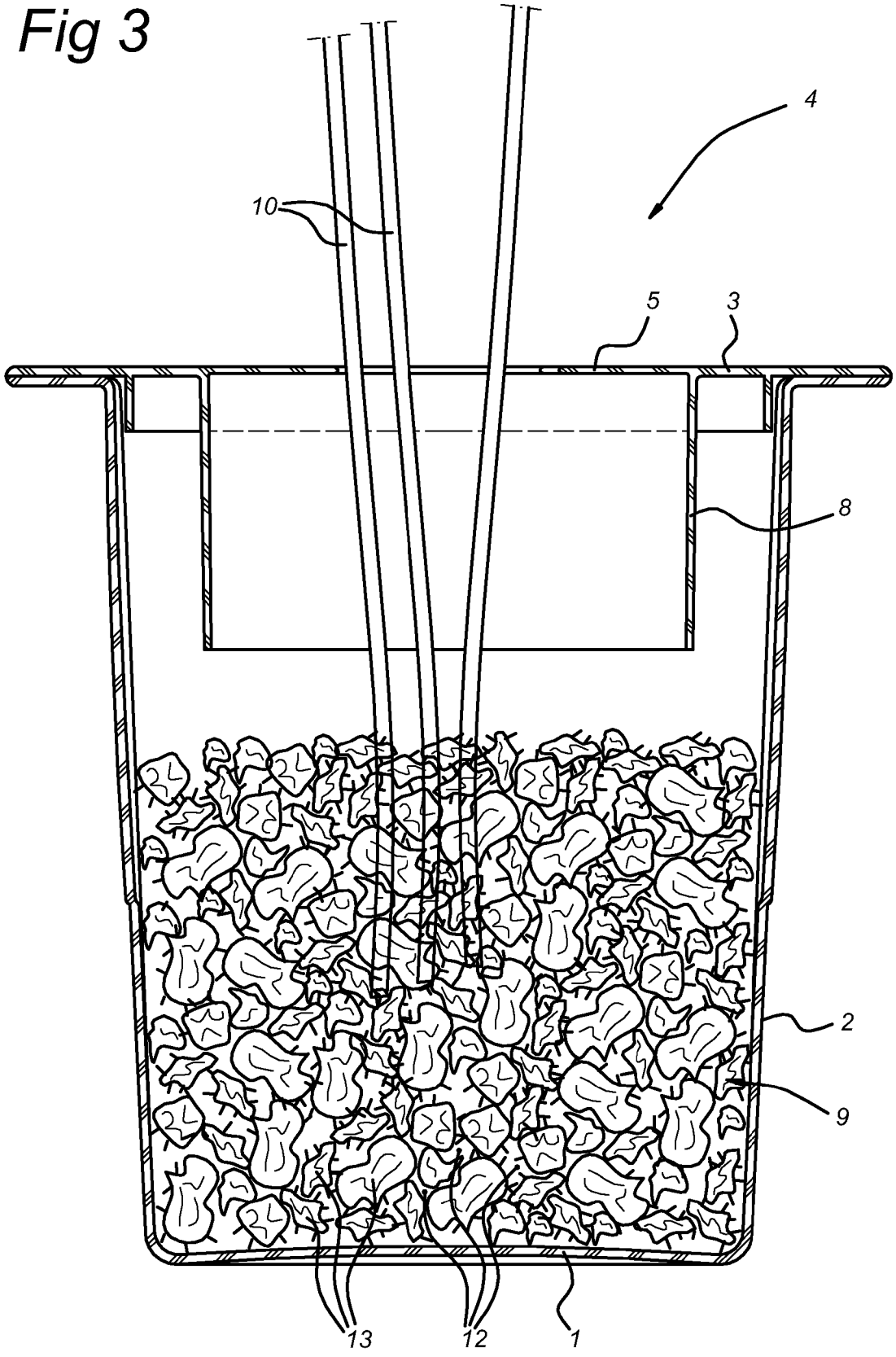
FIG. 3 shows an alternatives cross-section

In the embodiment of FIG. 3, it is shown that the stems 10 can also be inserted into the material 9. These stems 10 can thus be nourished during an appreciable amount of time with water present in the pores 12 of the material 9.

After use, the packaging is usually thrown away. Waste processing such packaging 1 is enabled, according to the invention, because in any case the container and the material 9 consist of the same substance, such as polyester polyethylene or polypropylene. The container can for instance be injection moulded from such substance, whereas the material is obtained by spinning and intermingling threads 13 of the same substance. To that end, no techniques are available which will not be discussed here.

The lid 3 as well can exist of the same substance as the container and material 9. The advantage of such a packaging which consists of one and only one substance, instead a different browser of need not be separated before being waste processed. Moreover such a way of waste processing is environmentally acceptable. This advantage can especially be seen in a comparison with the prior art packagings, which use for instance rockwool or oasis as a water containing material.

The invention claimed is:

1. A device for transporting plants comprising only a single container in which a quantity of water can be accommodated, comprising a base, a peripheral wall that is upright with respect to the base, a lid comprising an insertion opening and provided on the peripheral wall, a water barrier provided within the peripheral wall and extending towards the base, in which insertion opening the stem or stems of plant products can be accommodated, as well as retaining means for retaining the stems, wherein the retaining means are situated in or around the insertion opening and are designed for holding the stems pressed down in the direction of the base under preloading, said retaining means comprising lips made as an integral part of the water barrier that are oriented towards the middle of the opening and that are able to tip about their base, and said water barrier comprising a sleeve extending from the lid near a base of the lips wherein the water bather is configured to prevent water from escaping from the container when the container is tipped or held upside-down.

2. The container according to claim 1, wherein the insertion opening has a round shape and the retaining means comprise lips oriented radially with respect to the insertion opening.

3. The container according to claim 1, wherein the lips are mounted so that they can turn or pivot.

4. The container according to claim 1, wherein the water barrier further comprises a ring adjoining the edge of the peripheral wall facing away from the base and oriented towards the interior and the sleeve adjoins the inside edge of the ring, is oriented towards the base, partially overlaps the peripheral wall and is situated at some distance from the base.

5. The container according to claim 4, wherein the lips are made as an integral part of the ring.

6. The container according to claim 4, wherein the insertion opening is determined in the sleeve.

7. The container according to claim 6, wherein the lips extend into the sleeve.

8. The container according to claim 1, wherein the peripheral wall has a square or rectangular shape.

9. The container according to claim 1, wherein a water absorbent material is situated on the base.

10. The container according to claim 9, wherein the container and the water-absorbent material are manufactured from a substance which is equal with respect to waste processing, such that the container and the material can be treated in a similar way in waste processing.

11. The container according to claim 10, wherein the container and the water-absorbent material comprise the same material.

12. The container according to claim 11, wherein the container and the water-absorbent material comprise exclusively the same substance.

13. The container according to claim 10, wherein the container comprises an injection moulded plastic material and the material comprises fibres of the same plastic substance.

14. The container according to claim 13, wherein the fibres are spun from said plastic substance.

15. The container according to claim 13, wherein the fibres are non-woven.

16. The container according to claim 13, wherein the fibres are intermingled.

17. The container according to claim 10, wherein the substance of the container and the water-absorbent material are biologically degradable.

18. The container according to claim 10, wherein the substance of the container and the water-absorbent material comprises polypropylene.

19. The container according to claim 9, wherein the substance of the container and of the water-absorbent material comprises polyester.

20. The container according to claim 9, wherein the water-absorbent material comprises mineral wool.

21. The container according to claim 1, wherein the lips extend in a single plane.

* * * * *

UNITED STATES PATENT AND TRADEMARK OFFICE

CERTIFICATE OF CORRECTION

PATENT NO. : 9,044,109 B2
APPLICATION NO. : 11/887772
DATED : June 2, 2015
INVENTOR(S) : Janus Adriaan Willem de Pagter et al.

It is certified that error appears in the above-identified patent and that said Letters Patent is hereby corrected as shown below:

Claims

Column 4, Line 21, Claim 1, delete "bather" and insert -- barrier --

Signed and Sealed this
Twenty-seventh Day of October, 2015

Michelle K. Lee

Michelle K. Lee
*Director of the United States Patent and Trademark Office*